United States Patent [19]

Hunsucker

[11] Patent Number: 4,465,732

[45] Date of Patent: Aug. 14, 1984

[54] PROCESS FOR TREATMENT OF FIBERS

[75] Inventor: Jerry H. Hunsucker, Terre Haute, Ind.

[73] Assignee: International Minerals & Chemical Corp., Terre Haute, Ind.

[21] Appl. No.: 494,837

[22] Filed: May 16, 1983

[51] Int. Cl.[3] ..... B32B 7/00; B05D 3/02

[52] U.S. Cl. ..... 428/270; 427/176; 427/355; 427/369; 427/389; 427/389.9; 427/391; 427/392; 427/393.2; 427/395; 427/396; 427/393; 427/394; 428/260; 428/274

[58] Field of Search ..... 427/389, 389.9, 391, 427/392, 393, 355, 176, 369, 393.2, 394; 428/270, 274, 260; 8/495, 115.6, 116 R, 128 R

[56] References Cited

U.S. PATENT DOCUMENTS

| | | | |
|---|---|---|---|
| 1,979,188 | 10/1934 | Bouhuys | 8/495 |
| 2,423,185 | 7/1947 | Gündel et al. | 8/495 X |
| 3,617,198 | 11/1971 | Reid et al. | 427/393.2 X |

FOREIGN PATENT DOCUMENTS

| | | | |
|---|---|---|---|
| 2042258 | 3/1972 | Fed. Rep. of Germany . | |
| 57-133277 | 8/1982 | Japan | 427/393.2 |

OTHER PUBLICATIONS

Chemical Abstracts, 77:7253h, (1972).

Chemical Abstracts, 66:19769s, (1967).

Reinhardt and Kullamn, "Moderate & Mineral Acid Catalysis For Durable-Press Finishing Under Mild-Curing Conditions", Textile Research Journal 44 No. 12, 948-952 (1974).

*Primary Examiner*—Thurman K. Page

*Attorney, Agent, or Firm*—Robert H. Dewey

[57] ABSTRACT

An improved method of treating fabrics made with natural fibers using hydroxymethylsulfonate to render the fabrics wrinkle resistant. According to the improved process, an alkylene glycol is incorporated in the sodium hydroxymethyl sulfonate padding bath used to impregnate the fabric thereby surprisingly reducing the amount of extractable formaldehyde from the dried fabrics.

10 Claims, No Drawings

PROCESS FOR TREATMENT OF FIBERS

BACKGROUND OF THE INVENTION

This invention relates to a process for treatment of materials made with natural fibers. In a particular aspect, this invention relates to an improved process for producing wrinkle resistant fabrics made from natural fibers.

The importance of dimensional stability, such as wrinkle resistance and durable press properties, in textile fabrics and non-woven cellulose products are well established and are of great importance and economic value to the textile industry. The majority of textile articles, both wearing apparel and household articles, available in the marketplace exhibit these properties to some beneficial degree. Although many synthetic fibers inherently possess resiliency and wrinkle resistance, fabrics containing natural fibers, such as wool and cellulose, must be chemically treated to acquire these important properties needed for the modern textile market.

The principal chemical treatments which produce wrinkle resistance and durable press properties in textiles and non-woven products are those in which the molecules are crosslinked, generally by reaction with a di- or polyfunctional agent with the fibers.

One process which has been in use for a number of years is to treat natural fiber textiles with a solution of sodium hydroxymethyl sulfonate at a pH of 1-2, pressing out excess solution and drying the fabric. The hydroxymethylsulfonate is prepared by condensing formaldehyde with sulfur dioxide in the presence of sodium hydroxide. However, at the pH at which it is used, the treating agent is present as the sulfonic acid. Although the process has been successful, it has the disadvantage of contributing substantial extractable formaldehyde to the textile. Since formaldehyde is suspected of being carcinogenic, it is essential to minimize such residues. Accordingly, there is a need for an improved process for producing wrinkle resistant fabrics of natural fibers.

SUMMARY OF THE INVENTION

It is an object of this invention to provide a process for treatment of materials made with natural fibers.

It is another object of this invention to provide an improved process for producing wrinkle resistant fabrics made from natural fibers.

It is yet another object of this invention to provide a method for reducing extractable formaldehyde in woven and non-woven fabrics which have been treated to provide wrinkle resistance.

Other objects of this invention will be apparent to those skilled in the art from the disclosure herein.

It is the discovery of this invention to provide an improved method of treating fabrics made with natural fibers using hydroxymethylsulfonate to render the fabrics wrinkle resistant. Accordingly to the improved process, an alkylene glycol is incorporated in the sodium hydroxymethyl sulfonate padding bath used to impregnate the fabric thereby surprisingly reducing the amount of extractable formaldehyde from the dried fabrics.

DETAILED DISCUSSION

According to the method of treating textile materials, it is known to prepare an aqueous padding bath containing about 10–12% sodium hydroxymethyl sulfonate and about 3% catalyst. The pH is adjusted to about 1 to 2.

The textile material, which includes those made from natural fibers such as wool or cellulosics and includes woven or non-woven textiles, paper goods, particle board, etc., is immersed in the solution until saturated. The material is then pressed to about a 60% wet pick-up and allowed to air dry, after which it is heated to about 150°–170° C., preferably about 160° C. for a time sufficient to effect a cure. At about 160° C., about 5 minutes heating time is sufficient.

The catalyst used in the practice of this invention is known in the art. Generally it is a zinc or magnesium salt of a mineral acid, e.g. the chloride, nitrate, sulfate, etc. Alkylamine and alkanolamine hydrochlorides are also useful. It is convenient to prepare the catalyst as an aqueous solution, e.g. 25 to 50% for addition to the bath. The amount employed is selected to provide the desired curing time. Generally about 1–3% by weight of the bath is sufficient.

The pH adjustment can be effected with any water-soluble mineral or organic acid. Generally a dilute acid such as dilute hydrochloric, phosphoric, sulfuric, p-toluene sulfonic, etc. will be used. The use of such acids is known in the art.

The alkylene glycol used in the practice of this invention can be any primary or secondary glycol known in the art, generally of 2 to 10 carbon atoms, including but not limited to ethylene glycol, propylene glycol, butylene glycol, pentanediol, hexanediol, dimethylol propionic acid, etc., or mixtures thereof, and can be straight-chain or branched-chain. The amount of glycol used can be varied somewhat depending on final properties desired. In general, about 1–6% (i.e. about 0.15 to 1.0 moles per liter) of ethylene glycol may be used based on the weight of the padding bath, and the higher glycols can be used in a molar equivalent amount.

It is contemplated that the products and objects which will benefit from the wrinkle resistance conferred by the process of the present invention will include but will not be limited to those made of natural fibers, principally wool and cellulose, both woven and non-woven. Of the woven fibers, cotton fabrics are the ones which are expected to receive the most benefit. Non-woven fabrics are usually made from cellulose fibers, e.g. wood fibers, and are used extensively. Much of the production of non-woven fabrics goes to disposable items where wrinkle resistance may not be of great importance, but the market for durables is increasing especially in clothing interliners, bedding, carpets, draperies, etc., where wrinkle resistance is important. Actually, it is contemplated that any cellulose containing product, such as paper goods will benefit from treatment with the resin, and the term fabric as used herein is intended to encompass such cellulose-containing product.

The invention will be better understood with reference to the following examples. It is understood that the examples are intended for illustration only and it is not intended that the invention be limited thereby.

EXAMPLE 1

A padding bath was prepared as follows:

| | |
|---|---|
| Sodium hydroxymethyl sulfonate | 11% |
| Zinc, 50% solution | 3% |
| Water | 86% |

The pH of the solution was adjusted to 1.0 using hydrochloric acid. In a similar manner, six additional solutions were prepared except that 1, 2, 3, 4, 5 and 6% respectively of ethylene glycol was added and the water content was adjusted accordingly. Each of these solutions was then used to treat cotton cloth as follows. A piece of cotton cloth, unsized, was dipped into each solution, patted dry and stretched, then placed in an oven at 160° C. for 5 minutes. Ten specimens, 40 mm long and 15 mm wide, were cut from the cloth, five with their long dimension parallel to the warp and five with their long dimension parallel to the filling. The recovery angle was then determined as set forth in Test Method 66–1968 of the American Association of Textile Colorists and Chemists. The results obtained are given in Table 1.

TABLE 1

| Ethylene glycol, % | 0 | 1 | 2 | 3 | 4 | 5 | 6 |
|---|---|---|---|---|---|---|---|
| Residual HCHO, ppm | 1351 | 490 | 356 | 239 | 214 | 203 | 146 |
| Recovery angle | 273 | 270 | 252 | 211 | 216 | 202 | 187 |
| Tensile strength | — | 31.6 | 49.7 | 50.3 | 41.0 | 44.0 | 48.5 |

EXAMPLE 2

The experiment of Example 1 was repeated in all essential details except that the cellulosic material was a blend of 65% polyester and 35% cotton. The results obtained are as follows.

TABLE 2

| Ethylene glycol, % | 0 | 1 | 2 | 3 | 4 | 5 | 6 |
|---|---|---|---|---|---|---|---|
| Residual HCHO, ppm | 1351 | 148 | 69 | 84 | 50 | 48 | 26 |
| Recovery Angle | 273 | 291 | 286 | 284 | 284 | 279 | 277 |
| Tensile strength | — | 80.6 | 83.3 | 90.5 | 88.6 | 84.6 | 88.3 |

I claim:

1. A method for preparing a wrinkle-resistant fabric having low extractable formaldehyde comprising the steps of (a) impregnating the fabric with a solution of sodium hydroxymethyl sulfonate and a primary or secondary alkylene glycol of 2 to 10 carbon atoms at an acidic pH in the presence of a catalyst, and (b) heating to about 150°–170° C. for a length of time to effect a cure.

2. The process of claim 1 wherein the alkylene glycol is ethylene glycol, propylene glycol, butylene glycol, pentanediol, hexanediol, dimethylol propionic acid or mixtures thereof.

3. The process of claim 2 wherein the glycol is ethylene glycol.

4. The process of claim 2 wherein the glycol is propylene glycol.

5. The process of claim 1 wherein the catalyst is a zinc, magnesium, alkylamine or alkanolamine salt of a mineral acid.

6. A wrinkle resistant fabric obtained by the method of claim 1.

7. The method of claim 1 where the fabric is a woven textile of wool or cotton.

8. The method of claim 1 wherein the fabric is a non-woven fabric of cellulose fibers.

9. A woven fabric of claim 6 made of cotton or wool.

10. A non-woven fabric of claim 6 made from cellulose fibers.

* * * * *

UNITED STATES PATENT AND TRADEMARK OFFICE

CERTIFICATE OF CORRECTION

PATENT NO. : 4,465,732

DATED : August 14, 1984

INVENTOR(S) : Jerry H. Hunsucker

It is certified that error appears in the above-identified patent and that said Letters Patent are hereby corrected as shown below:

Column 1, line 57, "Accordingly" should read -- According --

Signed and Sealed this

*Sixteenth* Day of *April 1985*

[SEAL]

*Attest:*

DONALD J. QUIGG

*Attesting Officer* *Acting Commissioner of Patents and Trademarks*